US009285090B2

(12) United States Patent
Hsu

(10) Patent No.: US 9,285,090 B2
(45) Date of Patent: Mar. 15, 2016

(54) VEHICLE HEADLIGHT ASSEMBLY

(71) Applicant: Chen-Wei Hsu, Tainan (TW)

(72) Inventor: Chen-Wei Hsu, Tainan (TW)

( * ) Notice: Subject to any disclaimer, the term of this patent is extended or adjusted under 35 U.S.C. 154(b) by 0 days.

(21) Appl. No.: 14/327,578

(22) Filed: Jul. 10, 2014

(65) Prior Publication Data

US 2016/0010822 A1 Jan. 14, 2016

(51) Int. Cl.
*F21S 8/10* (2006.01)

(52) U.S. Cl.
CPC ..... *F21S 48/1154* (2013.01); *F21S 48/1104* (2013.01); *F21S 48/1283* (2013.01); *F21S 48/328* (2013.01)

(58) Field of Classification Search
None
See application file for complete search history.

(56) References Cited

U.S. PATENT DOCUMENTS 6,441,943 B1 * 8/2002 Roberts ..... B60Q 1/2665 250/214 AL
2003/0214810 A1 * 11/2003 Zhang ..... 362/294
2006/0109654 A1 * 5/2006 Coushaine ..... F21K 9/00 362/294
2008/0175003 A1 * 7/2008 Tsou ..... F21S 48/328 362/294
2010/0110660 A1 * 5/2010 Brukilacchio ..... 362/84
2010/0128479 A1 * 5/2010 Biebl ..... F21K 9/00 362/249.02
2010/0135037 A1 * 6/2010 Tsukamoto ..... F21S 48/1159 362/538
2010/0253223 A1 * 10/2010 Inoue ..... F21S 48/1159 315/82
2011/0051453 A1 * 3/2011 Nagasawa ..... B60Q 1/007 362/547
2011/0267780 A1 * 11/2011 Thrailkill ..... F21S 48/328 361/709
2012/0307501 A1 * 12/2012 Tankala et al. ..... 362/294
2013/0265793 A1 * 10/2013 Helbig et al. ..... 362/538
2013/0308328 A1 * 11/2013 Rice et al. ..... 362/516

* cited by examiner

*Primary Examiner* — Charlie Y Peng

(57) ABSTRACT

A head light assembly includes a body having a base and a connection portion respectively connected to two ends thereof. A circuit board is connected to the base and has at least two Light Emitting Diodes (LEDs). A lens is connected to the base and has a room in which the circuit board is located. The lens has a high beam area and a low beam area. The at least two Light Emitting Diodes (LEDs) are respectively located corresponding to the high beam area and the low beam area. A heat removing member is connected to the connection portion and has multiple fins.

1 Claim, 10 Drawing Sheets

VEHICLE HEADLIGHT ASSEMBLY

BACKGROUND OF THE INVENTION

1. Fields of the Invention

The present invention relates to a head light assembly, and more particularly, to a head light assembly having two Light Emitting Diodes (LEDs) which are located corresponding to a low beam area and a high beam area of a lens.

2. Descriptions of Related Art

The conventional head light assembly 1 is disclosed in FIGS. 1 and 2, and generally comprises a shade 10 in which a space 100 is defined. The space 100 is defined by a curved reflection face 101 and a light bulb 11 is located in the space 100, such as an incandescent light bulb or a xenon light bulb. A separation board 12 and a connection member 13 are located at the front side of the shade 10. The separation board 13 has a hole 120. A fence unit 14 is located in the connection member 13 and has an electro-magnetic valve 140 and a fence 141. A cover 15 is connected to the connection member 13 by a fixing frame 16. The light beams generated from the light bulb 11 is reflected by the reflection face 101 and pass through the cover 15 to illumination the road form the driver. The fence unit 14 is used to control the angle and range that the light beams reach and form the low beam and the high beam. However, the light beams reflected from the reflection face 101 are random and not concentrated, the illumination is not sufficient and may affects road safety. The conventional incandescent light bulb or the xenon light bulb in the space 100 of the shade 10 generates significant heat during operation and there is not proper heat removing device on the shade 10 so that the heat cannot be removed and is trapped in the shade 10, the high temperature shortens the life of the light bulb 11. Besides, the conventional head light assembly has to be equipped with the fence unit 14 to control the angle and range of the light beams, so that the conventional head light assembly is bulky and expensive.

Another head light assembly uses Light Emitting Diodes LEDs as the light source which provide higher illumination but cannot be concentrated and may confuse the coming drivers. The conventional LEDs head light assembly cannot make an obvious high beam and low beam.

The present invention intends to provide a head light assembly which eliminates the shortcomings mentioned above.

SUMMARY OF THE INVENTION

The present invention relates to a head light assembly and comprises a body having a base connected to the first end thereof, and the base has threaded holes. A connection portion is connected to the second end of the body. A circuit board is connected to the base and has at least two Light Emitting Diodes (LEDs). The circuit board has through holes which are located corresponding to the threaded holes of the base. Bolts extend through the through holes and are connected to the threaded holes to connect the circuit board to the base. A lens is connected to the base and has a room. The circuit board is located in the room. The lens has a high beam area and a low beam area. The at least two Light Emitting Diodes (LEDs) are respectively located corresponding to the high beam area and the low beam area. A heat removing member is connected to the connection portion and has multiple fins.

Preferably, the base has multiple fins.

Preferably, the high beam area has a concave face defined in the outside thereof. A cone-shaped portion extends from the inside of the high beam area and extends toward the room.

The cone-shaped portion has a recess and one of the at least two Light Emitting Diodes (LEDs) is located in the recess. The low beam area has a convex-curved face defined in the outside thereof. A flat surface is formed at the inside of the low beam area.

Preferably, the circuit board has multiple positioning holes. The room of the lens has multiple post extending from the inside thereof. Each post has an insertion on the distal end thereof The insertions are engaged with the positioning holes of the circuit board.

Preferably, the connection portion has outer threads defined in the outside thereof. The heat-removing member has a central hole which has inner threads defined in the inner periphery thereof. The outer threads of the connection portion are engaged with the inner threads of the heat-removing member.

Preferably, the heat-removing member has multiple passages.

The primary object of the present invention is to provide a head light assembly wherein the no fence unit is needed and the light beams generated from the LEDs can be controlled to create a high beam and a low beam. The high temperature generated from the LEDs is removed by the heat-removing member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
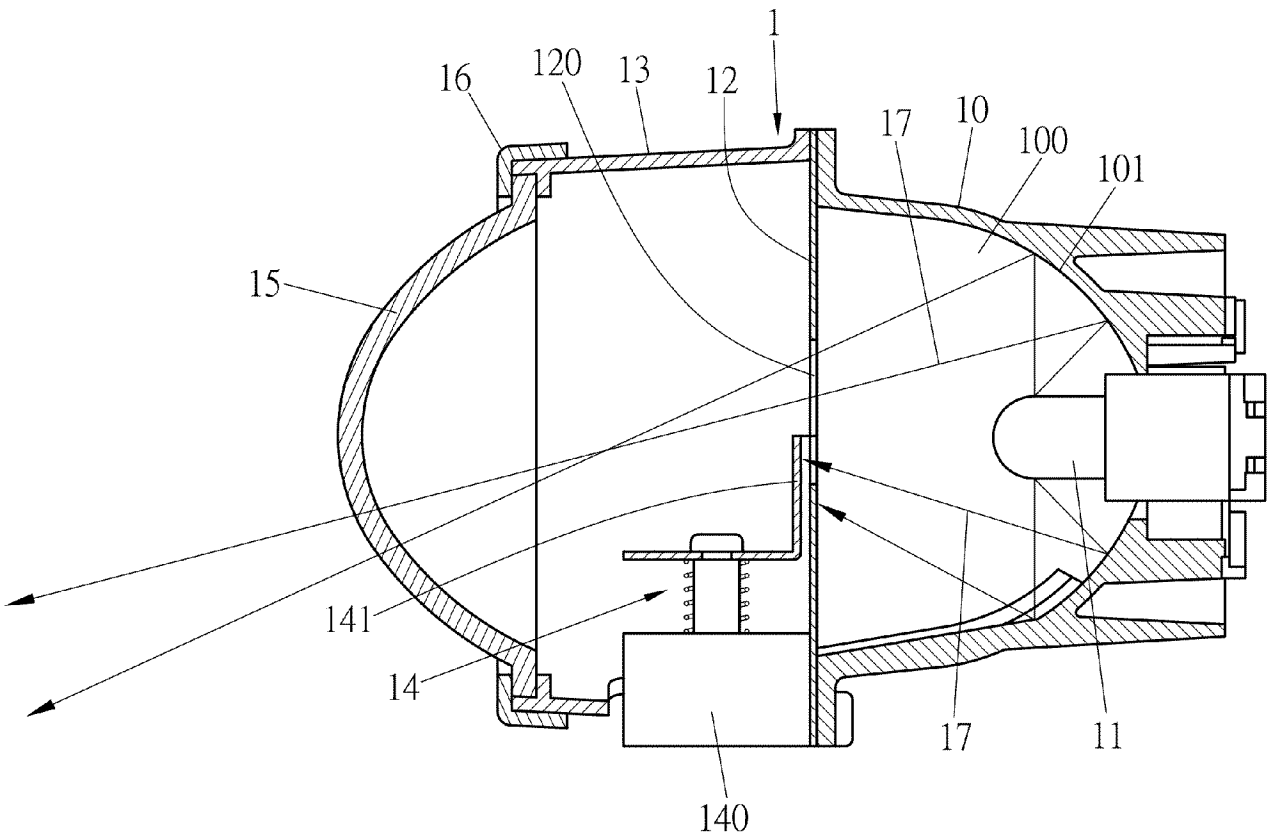
FIG.1 (PRIOR ART)
FIG. 1 is a cross sectional view to show a conventional heat light assembly wherein the low beam is created.
Figure 2:
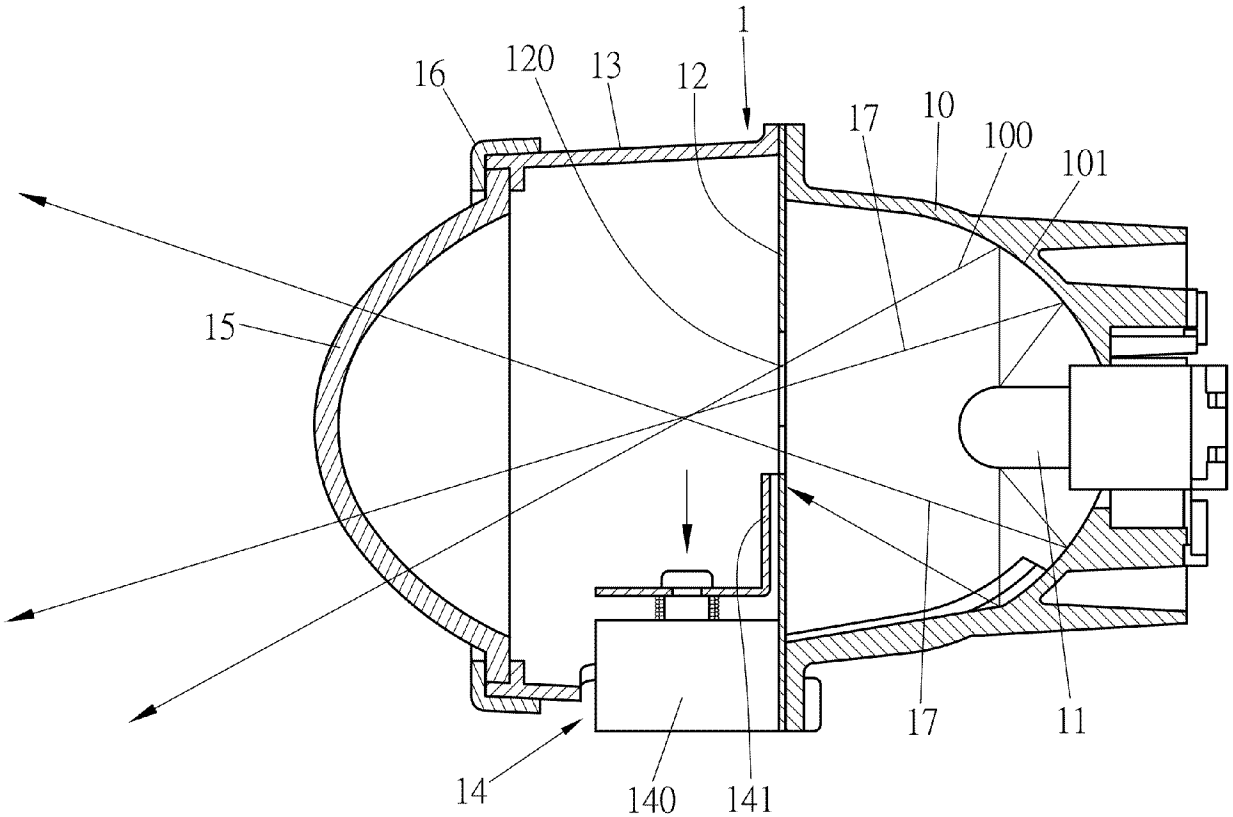
FIG.2 (PRIOR ART)
FIG. 2 is a cross sectional view to show a conventional heat light assembly wherein the high beam is created.
Figure 3:
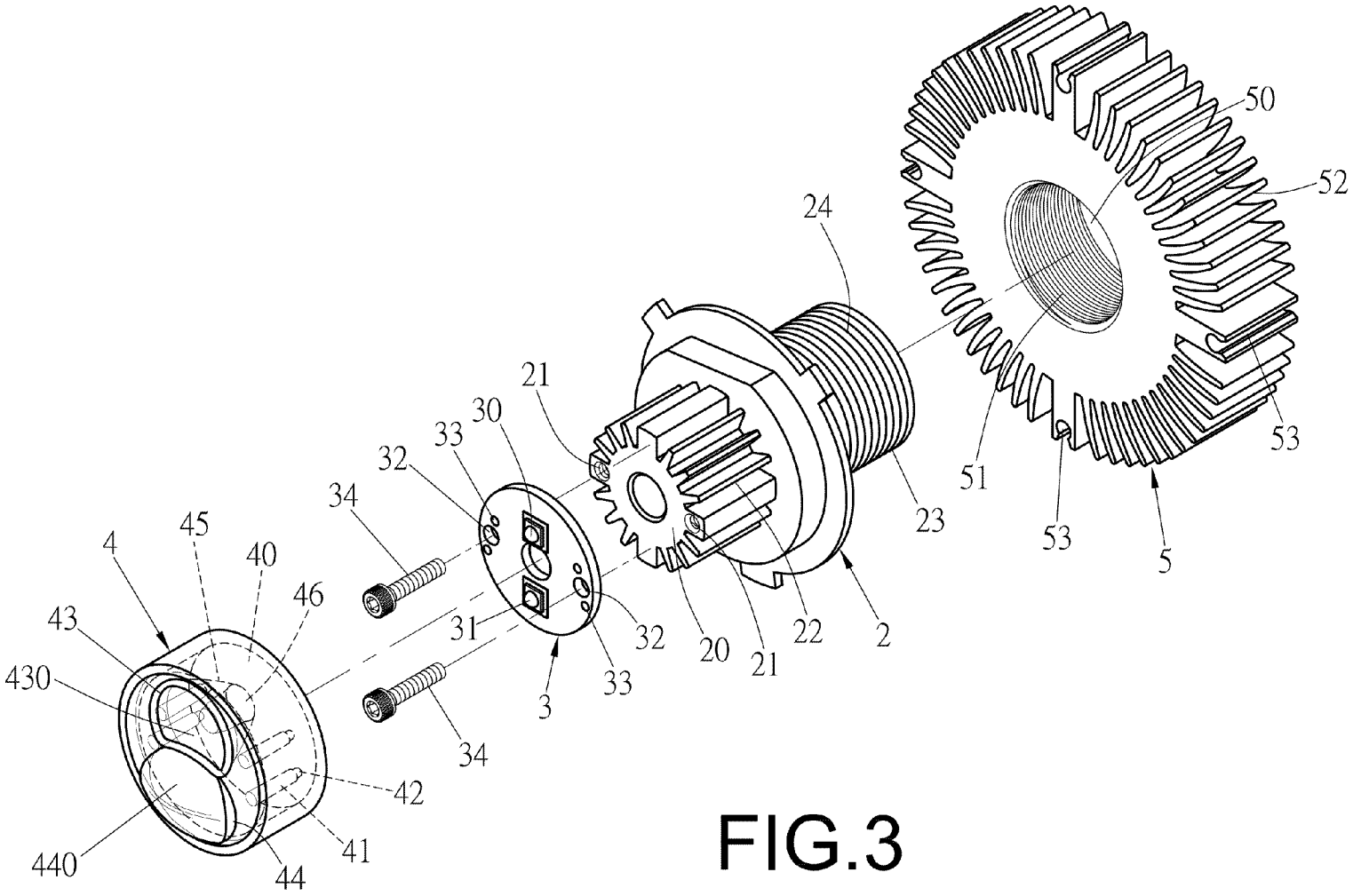
FIG. 3 is an exploded view of the heat light assembly of the present invention.
Figure 4:
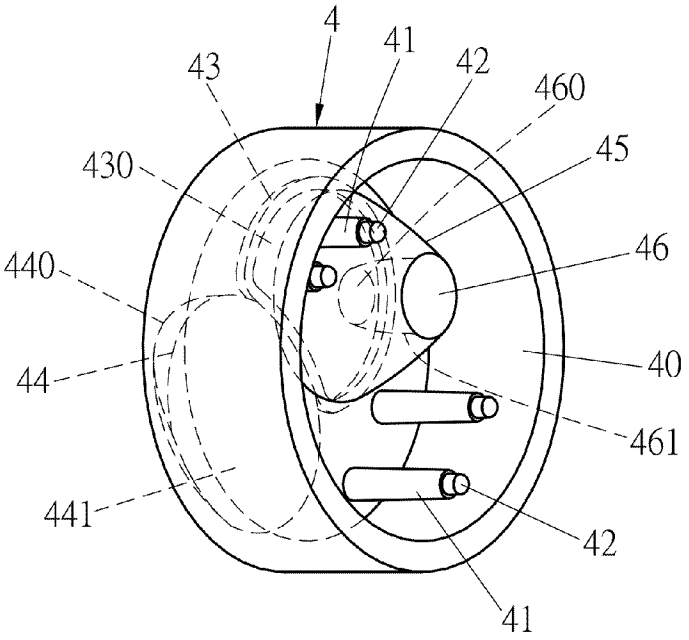
FIG. 4 is a perspective view to show the lens of the heat light assembly of the present invention.
Figure 5:
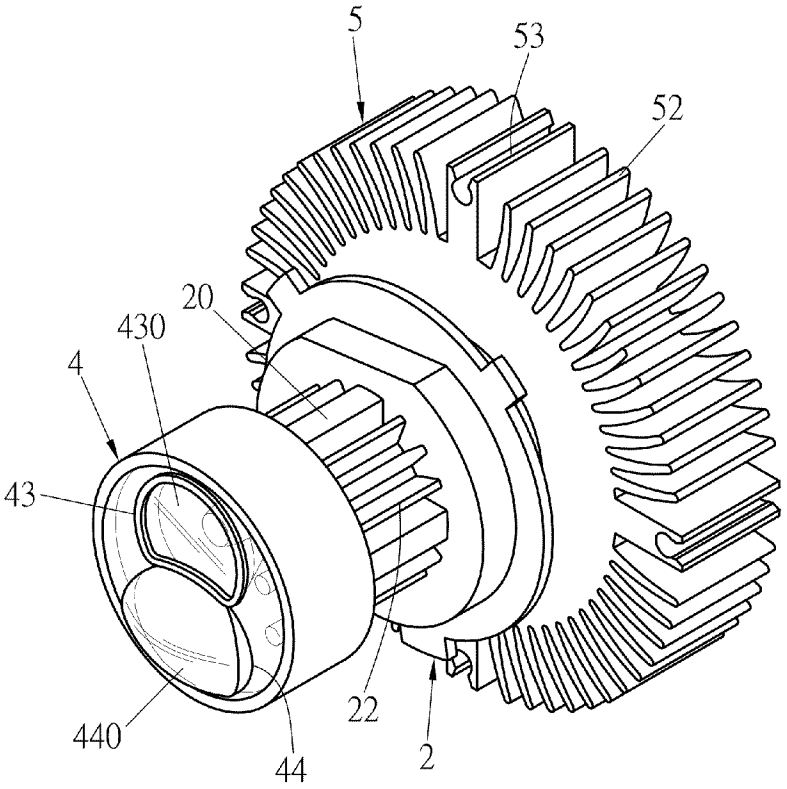
FIG. 5 is a perspective view to show the lens of the heat light assembly of the present invention.
Figure 6:
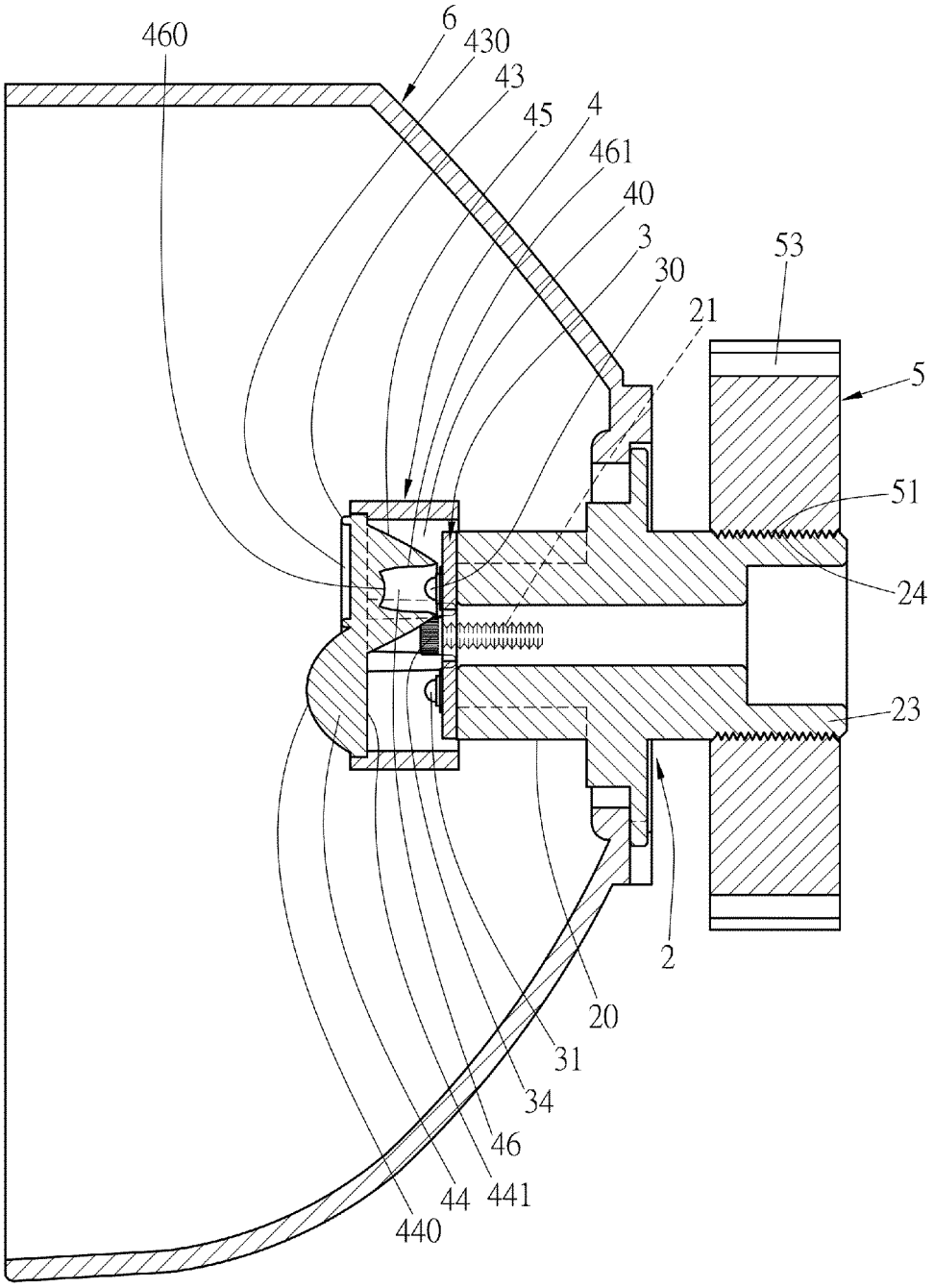
FIG. 6 is a cross sectional view to show the lens of the heat light assembly of the present invention.

Referring to FIGS. 3 to 4, the head light assembly of the present invention comprises a body 2 having a base 20 connected to the first end thereof, and the base 20 has threaded holes 21. The base 20 further has multiple fins 22. A connection portion 23 is connected to the second end of the body 2 and has outer threads 24 defined in the outside thereof. A circuit board 3 is connected to the base 20 and has at least two Light Emitting Diodes (LEDs) 30, 31. The circuit board 3 has through holes 32 which are located corresponding to the threaded holes 21 of the base 20. Bolts 34 extend through the through holes 32 and are connected to the threaded holes 21 to connect the circuit board 3 to the base 20. The circuit board 3 has multiple positioning holes 33.

A lens 4 is connected to the base 20 and has a room 40 in which the circuit board 3 is located. The lens 4 has a high beam area 43 and a low beam area 44, wherein the at least two Light Emitting Diodes (LEDs) 30, 31 are respectively located corresponding to the high beam area 43 and the low beam area 44. The room 40 of the lens 4 has multiple post 41 extending from the inside thereof. Each post 41 has an insertion 42 on the distal end thereof and the insertions 42 are engaged with the positioning holes 33 of the circuit board 3 so as to position the lens 4 to the base 2.

The high beam area 43 has a concave face 430 defined in the outside thereof, and a cone-shaped portion 45 extends from the inside of the high beam area 43 and toward the room 40. The cone-shaped portion has a recess 46 which has a convex-curved face 460 defined in the inside thereof, and the recess 46 has a curved face 461 defined in the outside thereof. The low beam area 44 has a convex-curved face 440 defined in the outside thereof, and a flat surface 441 is formed at the inside of the low beam area 44.

A heat removing member 5 is connected to the connection portion 23 and has multiple fins 52. The heat-removing member 5 has a central hole 50 which has inner threads 51 defined in the inner periphery thereof. The outer threads 24 of the connection portion 23 are engaged with the inner threads 51 of the heat-removing member 5.

When in assembling, as shown in FIGS. 3 to 6, the circuit board 3 is connected to the base 20 by extending the bolts 34 through the through holes 32 of the circuit board 3 and connected with the threaded holes 21 of the base 20. The lens 4 is then connected to the base 20 and the circuit board 3 is located in the room 40. The posts 41 of the lens 4 are located in alignment with the positioning holes 33 of the circuit board 3, the insertions 41 are engaged with the positioning holes 33 to position the lens 4 to the body 2. The Light Emitting Diode (LED) 30 that is located in the high beam area 43 is accommodated in the recess 46. The other Light Emitting Diode (LED) 31 is located corresponding to the low beam area 44. The connection portion 23 of the body 2 is threadedly connected to the central hole 50 of the heat-removing member 5 by the engagement between the inner threads 51 and the outer threads 24. The body 2 is accommodated in the shade 6 to complete the assembly.

Figure 7:
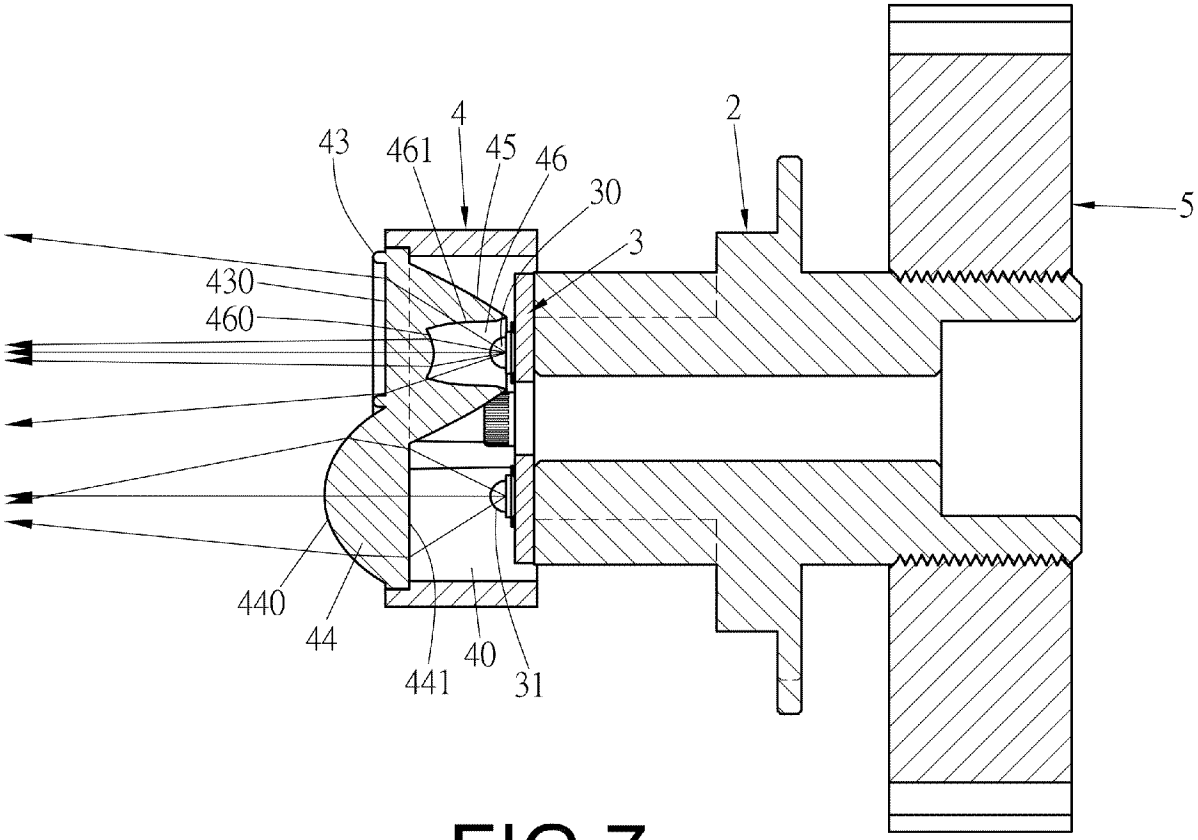
FIG. 7 is a cross sectional view to show the heat light assembly of the present invention wherein the high beam is created.
Figure 8:
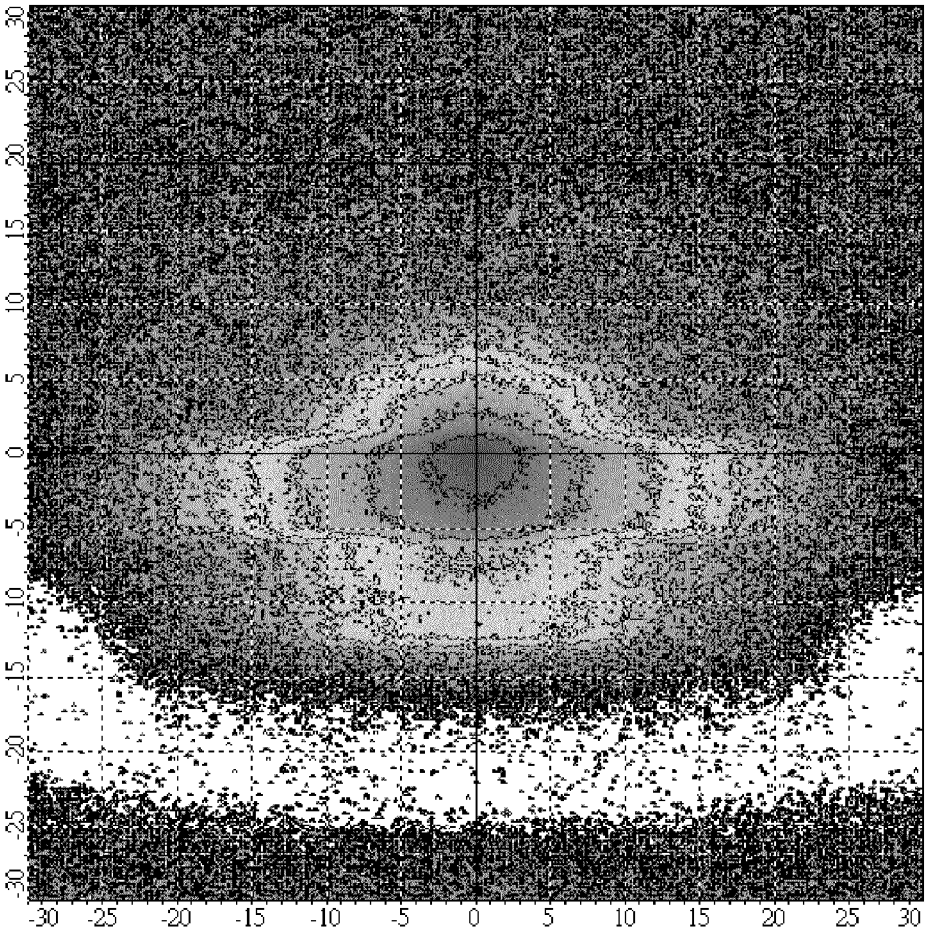
FIG. 8 illustrates the light pattern of the high beam generated from the heat light assembly of the present invention.

When using the high beam, as shown in FIGS. 7 to 10, the at least two Light Emitting Diodes (LEDs) 30, 31 are both activated and the Light Emitting Diode (LED) 30 that is located at the low beam area 44 only be activated by half of its power. The light beams generated from both of the Light Emitting Diodes (LEDs) 30, 31 pass through the different curvatures of the low beam area 44 and the high beam area 43 of the lens 4 to control the angle and range of the light beams. The high beam is illustrated as shown in FIGS. 7 and 8.

When using the low beam, as shown in FIGS. 7 to 10, the Light

Figure 9:
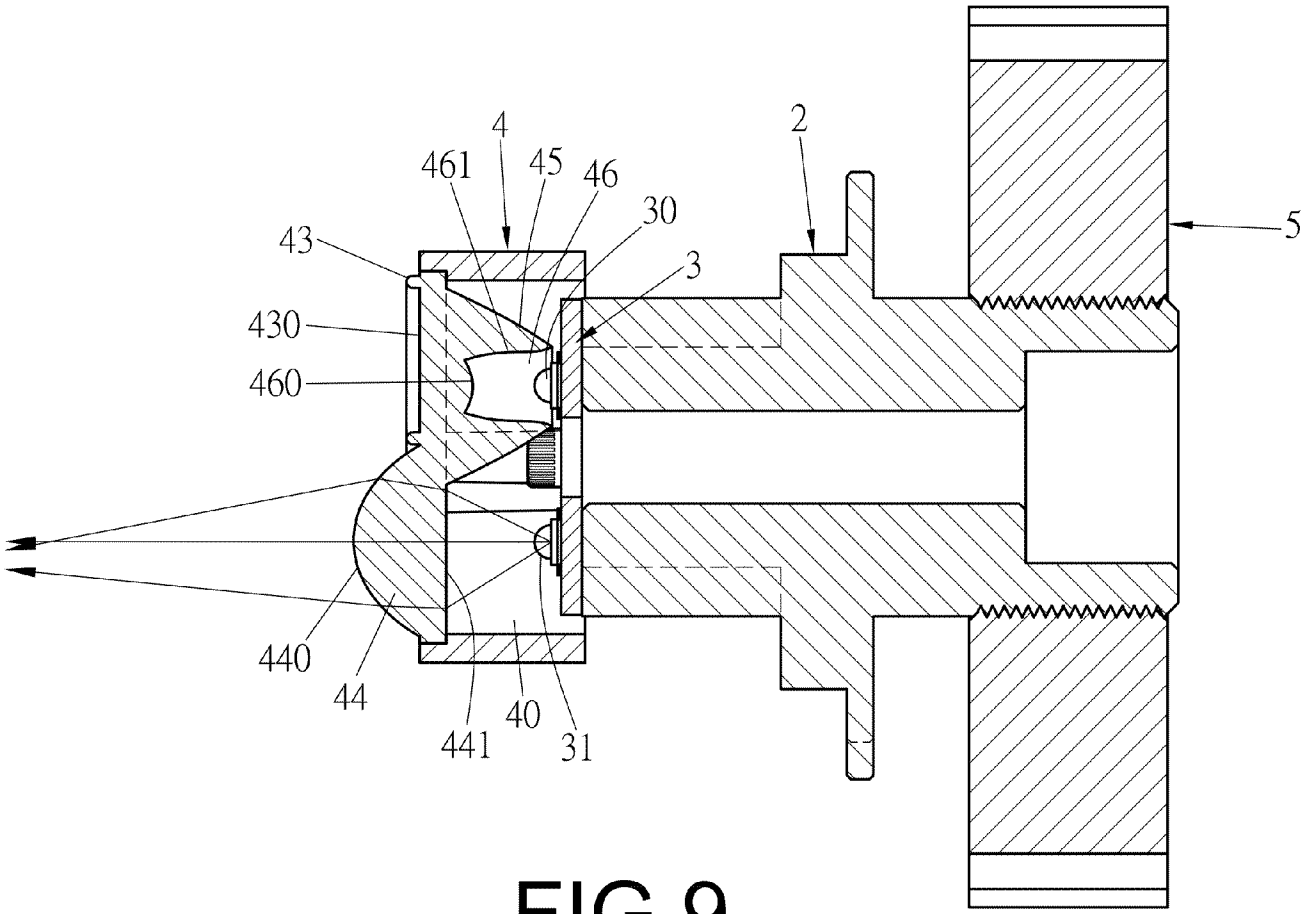
FIG. 9 is a cross sectional view to show the heat light assembly of the present invention wherein the low beam is created.
Figure 10:
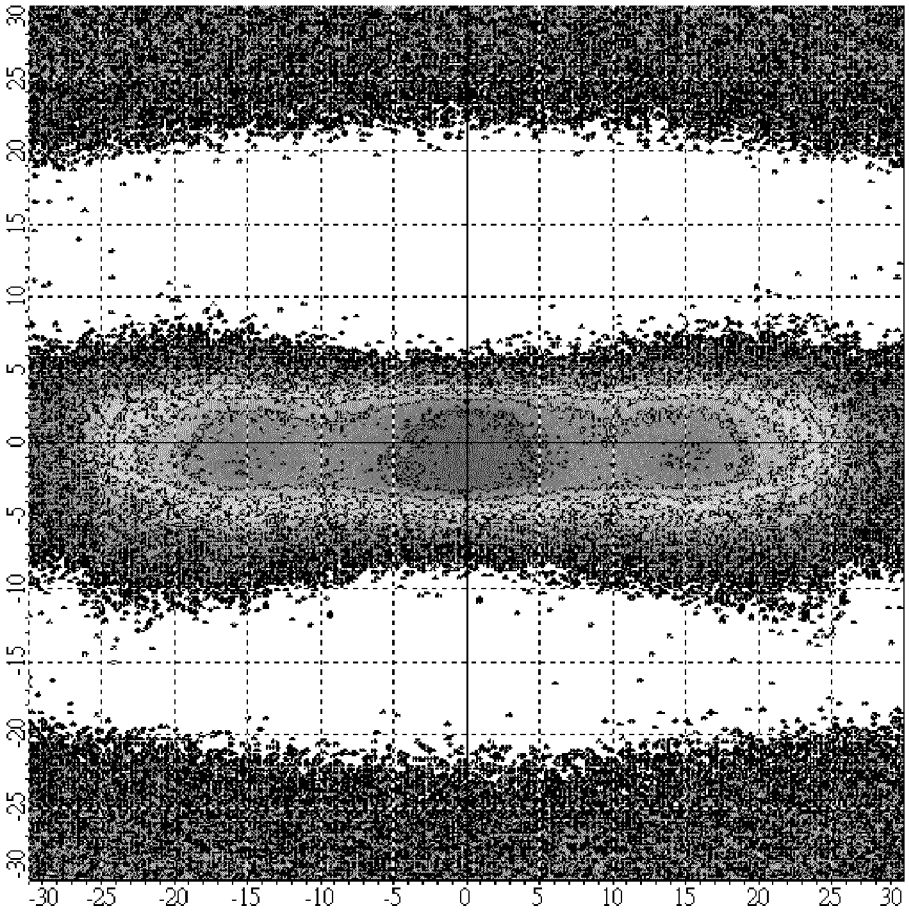
FIG. 10 illustrates the light pattern of the low beam generated from the heat light assembly of the present invention.

Emitting Diode (LED) 31 that is located at the low beam area 44 is activated to its full power, and the Light Emitting Diode (LED) 30 that is located at the high beam area 43 is shut off. The light beams generated from the Light Emitting Diode (LED) 31 pass through the low beam area 44 of the lens 4 to illuminate the short distance of the road as shown in FIGS. 9 and 10.

The different curvatures of the low beam area 44 and the high beam area 43 of the lens 4 control the angle and range of the light beams. No fence unit and/or convex lens are needed in the shade 6. Only the Light Emitting Diodes (LEDs) 30, 31 cooperated with the different curvatures of the low beam area 44 and the high beam area 43 of the lens 4 to achieve the purposes of controlling the low beam and the high beam. The light beams are even and do not create glare to the coming drivers. The fins 22 on the body 2 and the fins 52 of the heat-removing member 5 quickly bring the heat generated from the at least two Light Emitting Diodes (LEDs) 30, 31 away from the head light assembly so as to prolong the life of the head light assembly.

While we have shown and described the embodiment in accordance with the present invention, it should be clear to those skilled in the art that further embodiments may be made without departing from the scope of the present invention.

What is claimed is:

1. A head light assembly comprising:

a body (2) having a base (20) connected to a first end thereof, and the base (20) having threaded holes (21); the base (20) further having multiple fins (22) at an outer side thereof; a connection portion (23) being connected to a second end of the body (2) and having outer threads (24) defined in the outside thereof; a circuit board being connected to the base (20) and having at least two Light Emitting Diodes (LEDs) (30, 31); the circuit board (3) having through holes (32) which are located corresponding to the threaded holes (21) of the base (20); bolts (34) extending through the through holes (32) and being connected to the threaded holes (21) to connect the circuit board (3) to the base (20); and the circuit board (3) having multiple positioning holes (33);

a lens (4) connected to the base (20) and having a room (40) locating the circuit board (3); the lens (4) having a high beam area (43) and a low beam area (44); wherein the at least two Light Emitting Diodes (LEDs) (30, 31) are respectively located on one side of the circuit board (3) and arranged corresponding to the high beam area (43) and the low beam area (44); the room (40) of the lens (4) having multiple post (41) extending from an inside thereof.; and each post (41) having an insertion (42) on a distal end thereof and the insertions (42) being engaged with the positioning holes (33) of the circuit board (3) so as to position the lens (4) to the base (2);

the high beam area (43) having a concave outer surface (430) at an outer side of the room (40) and a cone-shaped portion (45) extending from a lower side of the concave outer surface (430) toward an inner side of the room (40); a smaller bottom side of the cone-shaped portion (45) having a recess (46) which is formed with a convex-curved wall (460); and the recess (46) having a curved inner face (461); the low beam area (44) having a convex-curved face (440) defined in the outside thereof, and a flat surface (441) being formed at an inside of the low beam area (44);

a heat removing member (5) connected to the connection portion (23) and having multiple fins (52); the heat-removing member (5) having a central hole (50) which has inner threads (51) defined in an inner periphery thereof; the outer threads (24) of the connection portion (23) being engaged with the inner threads (51) of the heat-removing member (5);

wherein when in assembling, the circuit board (3) is connected to the base (20) by extending the bolts (34) through the through holes (32) of the circuit board (3) and connected with the threaded holes (21) of the base (20); and the lens (4) is then connected to the base (20) and the circuit board (3) is located in the room (40); the posts (41) of the lens (4) are located in alignment with the positioning holes (33) of the circuit board (3), the insertions (41) are engaged with the positioning holes (33) to position the lens (4) to the body (2); the Light Emitting Diode (LED) (30) located in the high beam area (43) is located within the recess (46); the other Light Emitting Diode (LED) (31) is located corresponding to the low beam area (44); the connection portion (23) of the body (2) is threadedly connected to the central hole (50) of the heat-removing member (5) by the engagement between the inner threads (51) and the outer threads (24); the body (2) is accommodated in the shade (6) to complete the assembly.

* * * * *